US006070593A

United States Patent [19]

Chase

[11] Patent Number: 6,070,593

[45] Date of Patent: Jun. 6, 2000

[54] METHOD AND APPARATUS FOR CUTTING AN END OF A CIGAR

[76] Inventor: Gene Chase, 2006 Delaware Ave. #2, Buffalo, N.Y. 14216-3528

[21] Appl. No.: 09/013,878

[22] Filed: Jan. 27, 1998

Related U.S. Application Data

[63] Continuation-in-part of application No. 08/762,735, Dec. 10, 1996, abandoned.

[51] Int. Cl.[7] ..... A24F 13/24

[52] U.S. Cl. ..... 131/328; 131/248; 131/252; 131/253; 131/254; 131/255; 604/198

[58] Field of Search ..... 131/255, 253, 131/254, 252, 248, 329, 88, 89, 91, 92, 94, 328; 600/564, 566, 567; 604/198; 206/276, 242

[56] References Cited

U.S. PATENT DOCUMENTS

| | | | |
|---|---|---|---|
| 1,667,065 | 4/1928 | Brosius | 131/255 |
| 2,472,344 | 6/1949 | Rosenbarger | 206/276 |
| 2,575,431 | 11/1951 | Smith | 206/276 |
| 2,715,961 | 8/1955 | Field | 131/256 |
| 3,978,981 | 9/1976 | Musick | 206/276 |
| 5,535,763 | 7/1996 | Conte | 131/255 |
| 5,862,808 | 6/1999 | Albarello | 131/255 |

*Primary Examiner*—James Derrington
*Attorney, Agent, or Firm*—The Bilicki Law Firm, P.C.

[57] ABSTRACT

The apparatus of the invention broadly comprises a generally cylindrically shaped, hollow handle having an inner diameter and an outer diameter and also having a first end and a second end, a generally cylindrically shaped cutting member fixedly secured within the first end of the handle, and, a cap member comprising a hollow cylinder having a longitudinal axis and a disk-like endplate secured at one end thereof, the cap member having an inner diameter which is larger than the outer diameter of at least one portion of the handle, the cap member also comprising a clip extending from the cylinder generally parallel to the longitudinal axis of the cylinder. The invention also comprises various modifications and alternative embodiments of the apparatus, as well as a method of cutting an end of a cigar using the various embodiments.

5 Claims, 4 Drawing Sheets

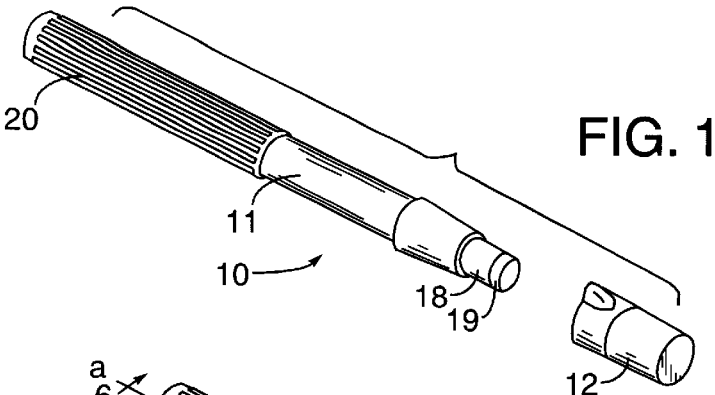
FIG. 1
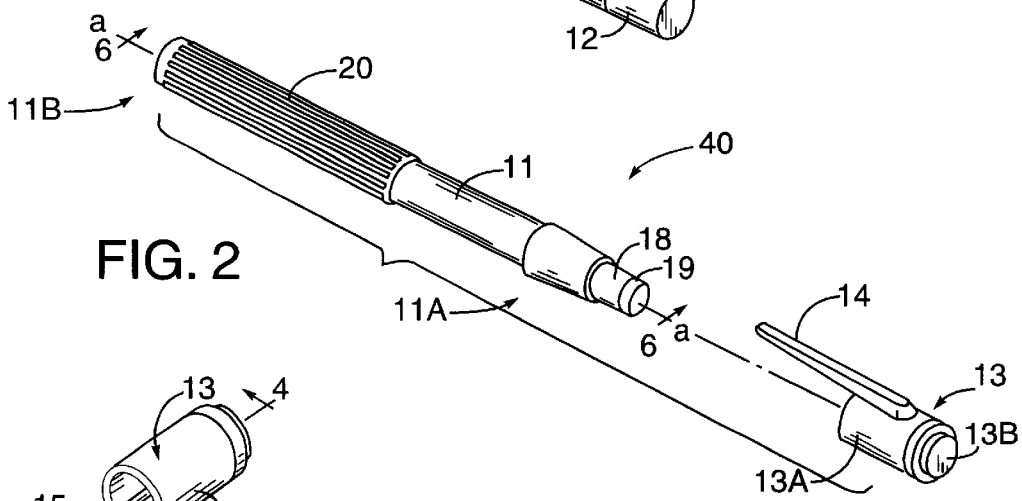
FIG. 2
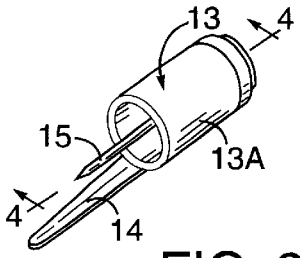
FIG. 3
FIG. 4
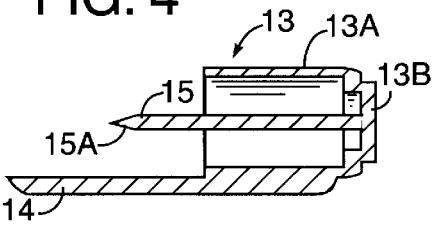
FIG. 5
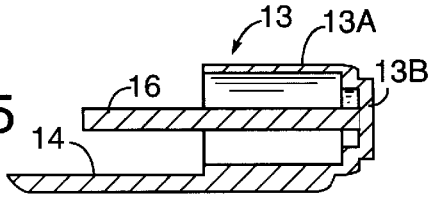

METHOD AND APPARATUS FOR CUTTING AN END OF A CIGAR

This is a Continuation-In-Part of U.S. patent application 08/762,735 filed Dec. 10, 1996, now abandoned.

FIELD OF THE INVENTION

This invention relates generally to a method and apparatus for cutting an end of a cigar and, more particularly, to an improved biopsy punch and new use of cutting an end of a cigar using the improved biopsy punch.

BACKGROUND OF THE INVENTION

Hand-rolled cigars have no openings in the end that is placed in the mouth, so they must be cut in some way to allow the smoke to be drawn into the mouth. Various clipping and cutting devices have been developed for this purpose. There are a number of scissors type devices that slice the end off of a cigar. There are also "cat's eye" or "V" cutters that slice a wedge out of the end of a cigar. The disadvantage of these types of cuts is that the cigar tends to unravel when it is chewed. What is needed then, is a method and apparatus for making a sharp, clean cut in the "mouth" end of a cigar, creating a passageway for the smoke, while maintaining the shape and integrity of the cigar, and preventing unraveling of the cigar.

SUMMARY OF THE INVENTION

The apparatus of the invention broadly comprises a generally cylindrically shaped, hollow handle having an inner diameter and an outer diameter and also having a first end and a second end, a generally cylindrically shaped cutting member fixedly secured within the first end of the handle, and, a cap member comprising a hollow cylinder having a longitudinal axis and a disk-like endplate secured at one end thereof, the cap member having an inner diameter which is larger thanthe outer diameter of at least one portion of the handle, the cap member also comprising a clip extending from the cylinder generally parallel to the longitudinal axis of the cylinder.

The invention also comprises various modifications and alternative embodiments of the apparatus, as well as a method of cutting an end of a cigar using the various embodiments.

The primary object of the invention is to provide an improved cigar cutter, and also to provide a new use for a biopsy punch which has been modified and improved.

BRIEF DESCRIPTION OF THE DRAWINGS

FIG. 1 is a perspective view of a prior art biopsy punch;

FIG. 2 is a perspective, partially exploded view of a first embodiment of the apparatus of the present invention;

FIG. 3 is a modified cap member of a second alternative embodiment of the apparatus of the invention;

FIG. 4 is a cross-sectional view of a modified cap member of a third alternative embodiment of the apparatus of the invention, taken generally along line 4—4 in FIG. 3;

FIG. 5 is a cross-sectional view of a modified cap member of a fourth alternative embodiment of the apparatus of the invention;

DETAILED DESCRIPTION OF THE PREFERRED EMBODIMENTS

Figure 6:
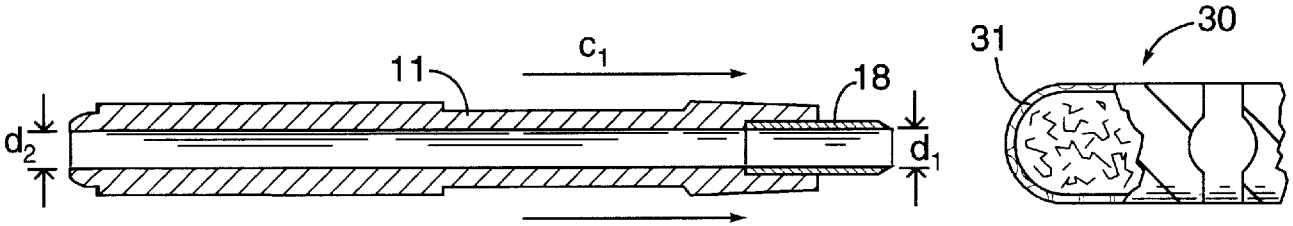
FIG. 6 is a cross-sectional view of the apparatus of the invention taken generally along line 6—6 in FIG. 2, as the apparatus is approaching a cigar (shown in fragmentary, partial cross-sectional view) to illustrate a step in the method of the invention.

At the outset, it should be understood that like reference numerals refer to identical structural elements of the invention on the various drawings.

FIG. 1 illustrates a prior art biopsy punch 10 which is commonly used by surgeons to remove portions of tissue for examination. The biopsy punch broadly comprises handle 11 which holds cutting member 18. The cutting member is usually cylindrical in shape and made of metal. The cylindrical cutting member contains a tapered section 19 which creates a sharp cutting edge. The handles contains a plurality of parallel ridges 20 for better gripping of the handle. The punch also includes a cap 12 which covers and protects the cutting member during non-use. Such a biopsy punch is available commercially from Fray Products, 2495 Main Street, Buffalo, N.Y. 14214 under the trademark "Biopunch". Surprisingly, and quite unexpectedly, the present inventor has discovered that the prior art biopsy punch is suitable (especially with modifications) for a new use, that of cutting ends of cigars. Although never intended for this purpose, the biopsy punch is capable of making a sharp, clean cut in the end of a cigar without causing an unraveling of the cigar. This is especially surprising in view of the differences between human tissue and tobacco leaves.

Adverting now to FIG. 2, the cigar cutter of the present invention comprises a generally cylindrically shaped, hollow handle 11 having a first end 11A and a second end 11B. Generally cylindrically shaped cutting member 18 is fixedly secured within the first end of the handle. The cutter also includes cap member 13 which comprises hollow cylinder section 13A and disk-like endplate section 13B. The inner diameter of the hollow cylinder of the cap is obviously larger than the outer diameter of at least one portion of the handle, proximate the cutting member, so that the cap fits over the end of the cutting member. The cylinder of the cap member has a longitudinal axis shown as α—α in FIG. 2. Cap member 13 also includes a clip 14 which extends from cylinder 13A generally parallel to longitudinal axis α—α.

FIG. 3 is a perspective view of an alternative embodiment of cap member 13. This embodiment further includes spike 15 which, has shown in cross-sectional view in FIG. 4, extends from endplate 13B outwardly through and beyond cylinder 13A. Spike 15 comes to a sharp point 15A, and is generally parallel to clip 14. Although spike 15 is coincident with longitudinal axis α—α in FIGS. 3 and 4, it is not necessary that it be so.

FIG. 5 is a cross-sectional view of yet another alternative embodiment of cap member 13. This embodiment includes plunger 16 (instead of spike 15) extending from endplate 13B outwardly through and beyond cylinder 13A. The plunger is shown as being generally parallel to clip 14.

Figure 15:
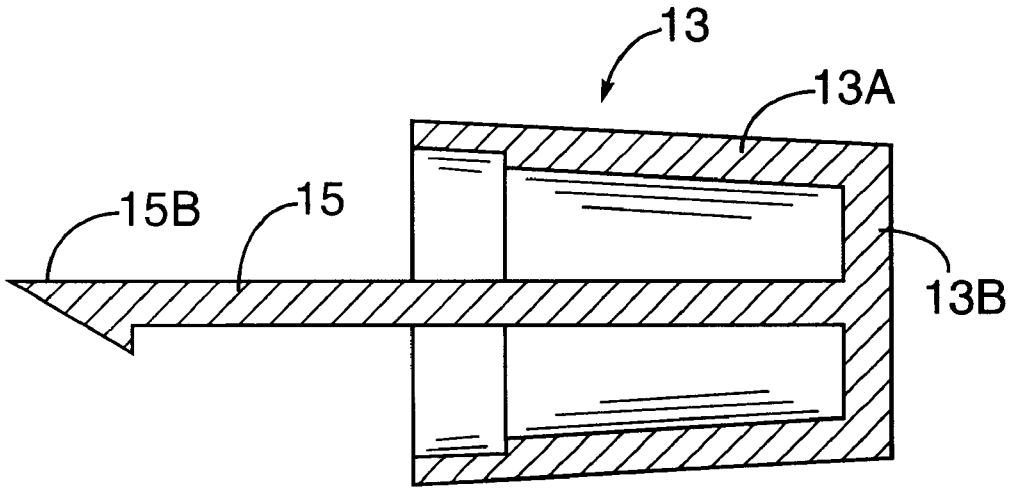
FIG. 15 is a cross-sectional view of a fifth embodiment of the cap of the invention.

FIG. 15 is a cross-sectional view of a fifth embodiment of the cap of the invention. In this embodiment, spike 15 comprises hook end 15B which is designed to penetrate the cigar and remove a portion thereof.

It should be noted that alternative embodiments of the invention, although not shown, could include cap members having either a spike or a plunger, but no clip.

Figure 7:
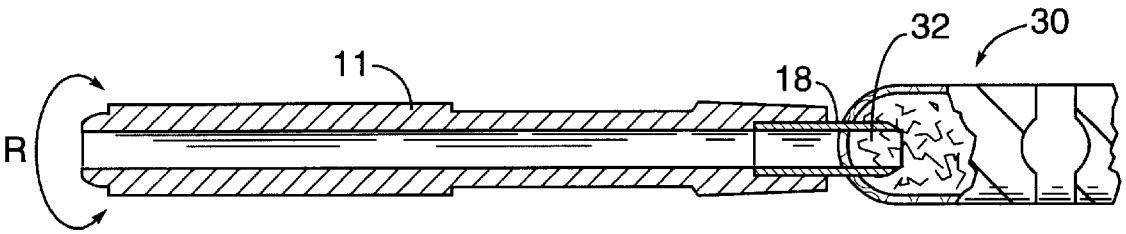
FIG. 7 illustrates the cutter of FIG. 6 inserted into the cigar and being twisted in another step in the method of the invention.
Figure 8:
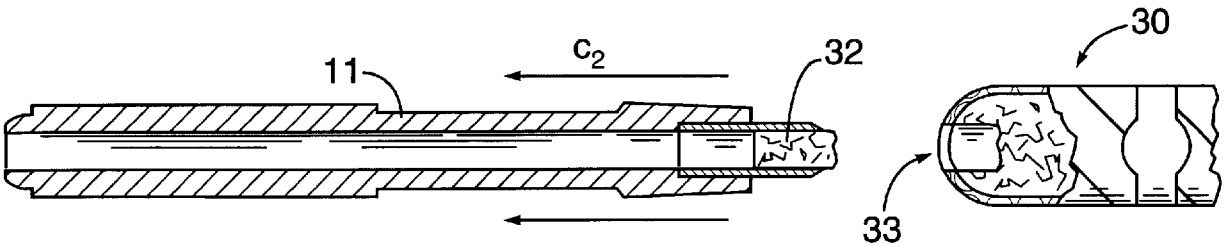
FIG. 8 illustrates the cutter of FIG. 7 being removed from the cigar, removing a portion of the cigar end which has been captured by the cutting member.

The method of the invention is best understood with reference to FIGS. 6–14. FIG. 6 illustrates handle 11 in close proximity to cigar 30. This cross-sectional view of the handle is also useful to illustrate the fact that the inner diameter $d_1$ of cutting member 18 is smaller than the inner diameter $d_2$ of handle 11. In this view, handle 11 is being moved in direction $C_1$ toward end 31 of cigar 30. In FIG. 7, cutting member 18 has punctured the end of the cigar and a portion 32 of the cigar has become captured by the cutting member. In FIG. 8, handle 11 is moved in the direction $C_2$ away from the cigar. As the cutting member withdraws from the cigar, it removes captured portion 32 thereof. As a result, cigar 30 now contains an opening 33 for the removal of smoke.

Figure 9:
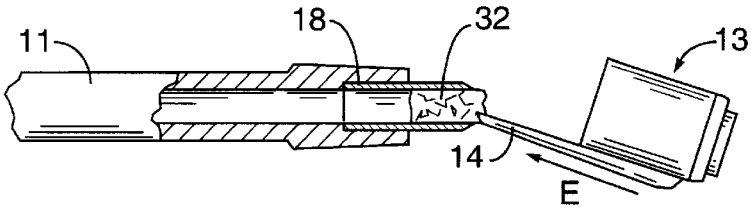
FIG. 9 illustrates how the clip of the cap member of the apparatus is inserted into the cutting member to dig or pick the captured portion of the cigar therefrom.
Figure 10:
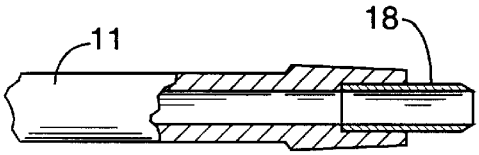
FIG. 10 illustrates removal of the captured portion of the cigar from the cutting member using the clip of the cap member.

Once portion 32 is removed from the cigar, clip 14 may be used to dig or pick the removed portion from the bore of the cutting member. FIG. 9 illustrates clip 14 being moved in direction E into contact with portion 32. Removal of portion 32 is shown in FIG. 10 where clip 14 is moved in direction F.

Figure 11:
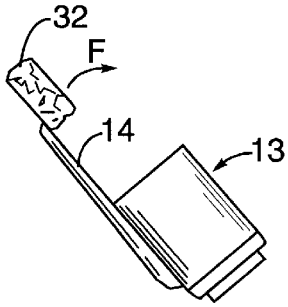
FIG. 11 illustrates use of the spike of the cutting member as it is inserted into the captured portion of the cigar within the cutting member.
Figure 11:
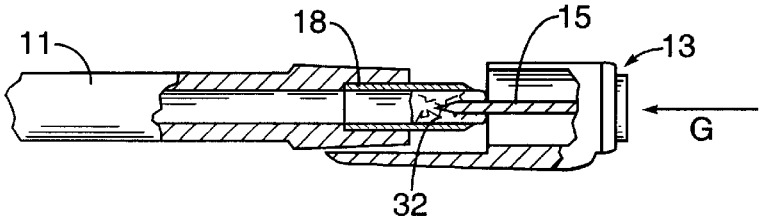
Figure 12:
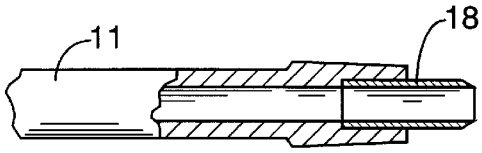
FIG. 12 illustrates removal of the captured portion of the cigar shown in FIG. 11 using the spike of the invention.

The alternative embodiment of cap 13 shown in FIGS. 3 and 4 may be used in a different way to remove portion 32. In FIG. 11, this "spike" embodiment of the cap is shown moving in direction G until spike 15 punctures portion 32. Cap 13 is then moved in direction H as shown in FIG. 12, removing portion 32 from the bore of cutting member 18.

Figure 13:
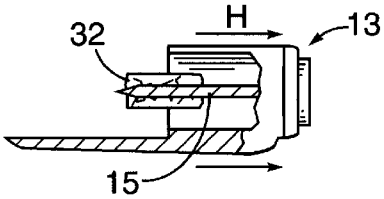
FIG. 13 illustrates insertion of the plunger of the cap member into the bore of the cutting member to push the captured portion of the cigar into the hollow handle.
Figure 13:
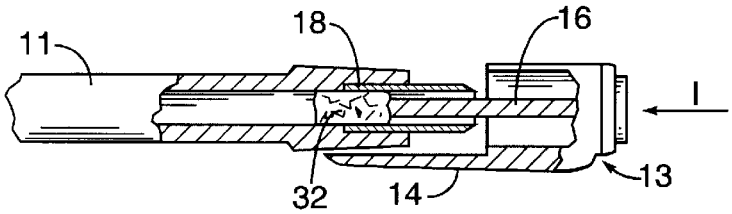
Figure 14:
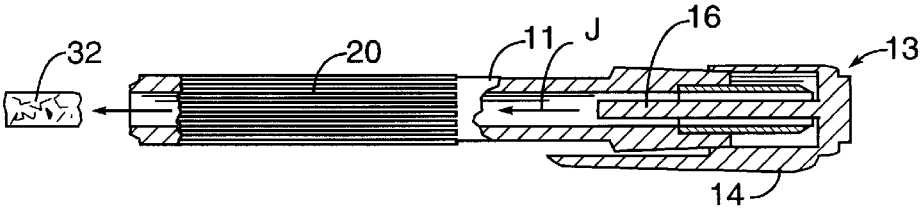
FIG. 14 illustrates how the captured portion of the cigar which has been pushed by the plunger is ejected from the bore of the handle.

Alternatively, the "plunger" embodiment of FIG. 5 may be used to extricate portion 32 from the handle. In this method, as illustrated in FIG. 13, plunger 16 is moved into contact with portion 32 by movement of the cap in direction I. With reference to FIG. 6, since inner diameter $d_2$ of handle 11 is larger than inner diameter $d_1$ of cutting member 18, portion 32 is ejected from handle 11 as best shown in FIG. 14.

Thus it is seen that the objects of the invention are efficiently attained. Surprisingly, a modified biopsy punch can be used efficiently for a purpose never intended or contemplated by the original inventors thereof. It should now be apparent to those having ordinary skill in the art that certain changes can be made in the invention, particularly in the cap member thereof, without departing from the spirit and scope of the appended claims.

What I claim is:

1. A cigar cutter comprising:

a generally cylindrically shaped, hollow handle having an outer diameter and also having a first end;

a generally cylindrically shaped cutting member fixedly secured within said first end of said handle; and, a cap member comprising a hollow cylinder having a disk-like endplate secured at one end of the cylinder, said cap member having an inner diameter which is larger than the outer diameter of at least one portion of said handle, said cap member also comprising a spike fixedly secured and emanating from the endplate.

2. A cigar cutter as recited in claim 1 wherein said spike has a hook at one end thereof.

3. A cigar cutter comprising:

a generally cylindrically shaped, hollow handle having an outer diameter and also having a first end end;

a generally cylindrically shaped cutting member fixedly secured within said first end of said handle; and, a cap member comprising a hollow cylinder having a disk-like endplate secured at one end of the cylinder, said cap member having an inner diameter which is larger than the outer diameter of at least one portion of said handle, said cap member also comprising a plunger fixedly secured and emanating from the endplate.

4. A method of cutting an end of a cigar using a modified biopsy punch having a clip and a cutting member with a cutting edge, comprising the steps of:

pushing the cutting edge of the punch into the end of the cigar;

twisting the handle to capture a portion of the cigar within the cutting member;

removing the cutting edge from the cigar, thereby removing said portion of the cigar; and, removing the captured potion of the cigar from the cutting member using the clip.

5. The method of claim 4 wherein the clip is used to dig or pick the captured portion of the cigar from the cutting member.

* * * * *